United States Patent [19]

Kimura

[11] Patent Number: 4,866,458

[45] Date of Patent: Sep. 12, 1989

[54] CLUTCH SYSTEM FOR MOTOR DRIVEN TELESCOPIC ANTENNA

[75] Inventor: Misao Kimura, Kanagawa, Japan

[73] Assignee: Harada Kogyo Kabushiki Kaisha, Tokyo, Japan

[21] Appl. No.: 227,470

[22] Filed: Aug. 2, 1988

Related U.S. Application Data

[63] Continuation of Ser. No. 11,037, Feb. 5, 1987, abandoned.

[30] Foreign Application Priority Data

Feb. 6, 1986 [JP] Japan ..... 61-22925

[51] Int. Cl.[4] ..... H01Q 1/10

[52] U.S. Cl. ..... 343/903; 343/714

[58] Field of Search ..... 343/903, 901, 714, 877; 242/54 A

[56] References Cited

U.S. PATENT DOCUMENTS 4,665,406 5/1987 Takizawa et al. ..... 343/903

FOREIGN PATENT DOCUMENTS 4623931 8/1961 Japan ..... 343/903
0046502 3/1982 Japan ..... 343/903
0150302 9/1983 Japan ..... 343/903

*Primary Examiner*—Rolf Hille
*Assistant Examiner*—Hoanganh Le
*Attorney, Agent, or Firm*—Koda and Androlia

[57] ABSTRACT

A clutch system for a motor driven telescopic antenna, a first rotor provided on a main shaft for moving an antenna drive cord of a telescopically adjustable antenna, a second rotor fitted over the main shaft and rotated by an electric motor, first and second clutch discs which are inserted over the main shaft and kept pressed in the shaft direction by a clamp in order to press hold both end surfaces of the second rotor in between by applying a pressurizing force to the second rotor. The clutch system further includes a clutch pressure setter for dissociating the first and second clutch discs from the second rotor when the force exceeding a specified clutch pressure that is set in relation to the engagement with the main shaft acts on the holding surfaces between the second rotor and the first and second clutch discs. The clutch pressure setter includes first uneven portions formed on both end surfaces, in the shaft direction, of a ring-form member that is coaxially inserted over the main shaft and on the center side of the second rotor and second uneven portions formed in the first and second clutch discs corresponding to the first uneven portions of the ring-form member.

2 Claims, 2 Drawing Sheets

CLUTCH SYSTEM FOR MOTOR DRIVEN TELESCOPIC ANTENNA

This is a continuation of application Ser. No. 011,037, filed Feb. 5, 1987 now abandoned.

BACKGROUND OF THE INVENTION

1. Field of the Invention

The present invention relates to a clutch system for power transmission in a motor driven telescopic antenna installed in automobiles, etc.

2. Prior Art

In general, this type of motor driven telescopic antenna is constructed as shown in FIG. 5. That is, it basically comprises an electric motor unit 1, a power transmission unit 2 and a telescopic antenna unit 3. For the electric motor unit 1, usually a torque motor, etc. is used. The power transmission unit 2 includes a power converter for converting the rotary motion of the electric motor unit 1 to linear motion, and a clutch system for releasing the power transmitting operation during overload of the telescopic antenna unit 3. In the telescopic antenna unit 3 a drive cord 3*a* is provided, and by the motion of reciprocal feeding of this drive cord 3*a*, that is performed by the linear motion of the power transmission unit 2, the antenna is extended or retracted.

As the clutch system mentioned above, various types of them have been used, and a representative one is that having the structure as mentioned below. That is, a main driving clutch disc, that rotates by receiving the driving force from the electric motor, and a follower clutch disc that is coupled under load with the former are positioned to be pressed into engagement. During the telescopic operation of the antenna, the antenna is extended or retracted by the driving force applied to the antenna side by means of the friction transmitting force between the foregoing main driving clutch disc and the follower clutch disc. At the time when the telescopic motion of the antenna is completed and the follower clutch disc stops, the main driving clutch disc slips. Thereafter, by actuating a limit switch, etc., the rotation of the main driving clutch is stopped.

In the clutch system having the structure as mentioned above, the transmission of the driving force from the electric motor side to the antenna side depends entirely on the transmission of the friction between the main driving clutch disc and the follower clutch disc. Also, the setting of the clutch pressure (corresponding to the force in the reciprocal feeding motion of the drive cord 3*a*) is done depending on the setting of the pressurizing force of the above. Accordingly, when dirt, contaminants, etc. become adhered to the clutch portion, that is, between the main driving clutch disc and the follower clutch disc, the clutch is not released even though the clutch pressure is above the set value (overloaded), thereby imposing an excessive load on the electric motor, and in the worst case, burning of the electric motor has been caused.

SUMMARY OF THE INVENTION

Therefore, the object of the present invention is to provide a clutch system for a motor driven telescopic antenna, that is designed to perform the clutching operation with the preset clutch pressure even when overloading occurs.

The above mentioned object is achieved by providing the clutch system with the following structure. That is, a first rotor for operating an antenna drive cord of a telescopic antenna is fitted on a main shaft, and a second rotor that is rotated by an electric motor is rotatably fitted on the main shaft. In order to hold both end surfaces of the foregoing second rotor in between, first and second clutch discs are inserted over the above mentioned main shaft. These first and second clutch discs are kept pressed in the direction of the axis of the main shaft by a spring means so that the first and second clutch discs press hold the foregoing second rotor in between. The clutch system further includes a clutch pressure setting means or mechanism on the main shaft for dissociating the first and second clutch discs from the second rotor when a force exceeding the preset clutch pressure which is set in relation to engagement with the above mentioned main shaft is applied to the surfaces of the second rotor.

With the mechanism designed as described above, during the normal loading state, the driving force is transmitted by the transmission of the normal friction among the second rotor and the first and second clutch discs. On the other hand, when overloading occurs on the antenna, because the clutch pressure exceeds the preset clutch pressure provided by the spring means, the first and second clutch discs become dissociated from the second rotor and slip. As a result, transmission of the driving force is reduced. Thus, it becomes possible for the second rotor to rotate with a light load approximately equal to the preset clutch pressure. Consequently, overloading of the electric motor is prevented from occurring.

DETAILED DESCRIPTION OF THE INVENTION

Figure 1:
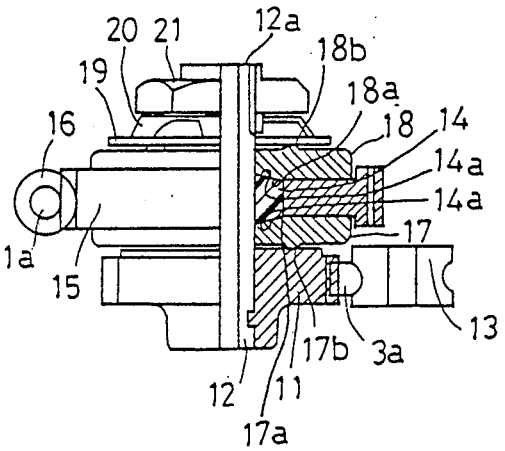
FIG. 1 is a sectional view showing an embodiment of this invention.
Figure 2:
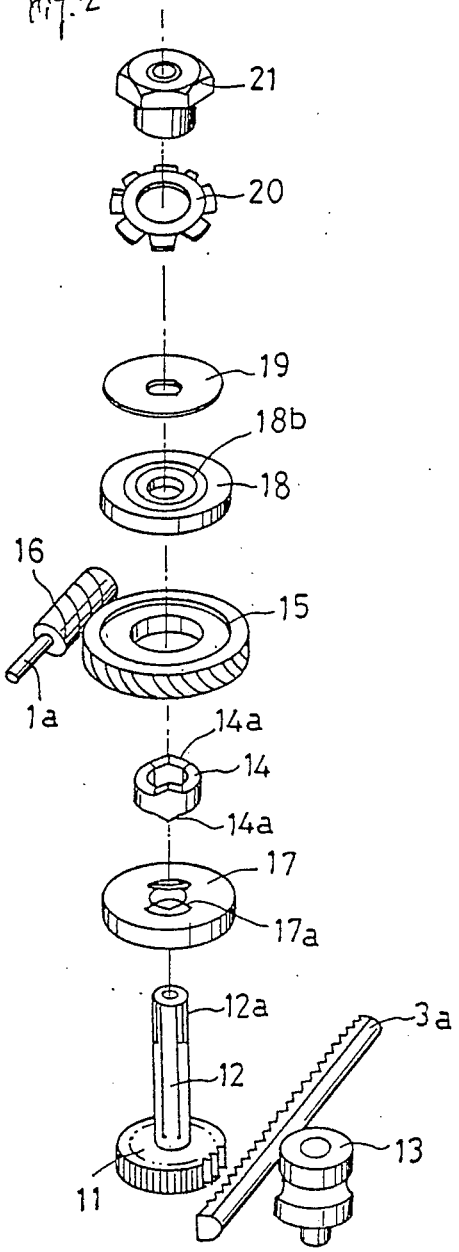
FIG. 2 is an exploded perspective view of the same embodiment.
Figure 5:
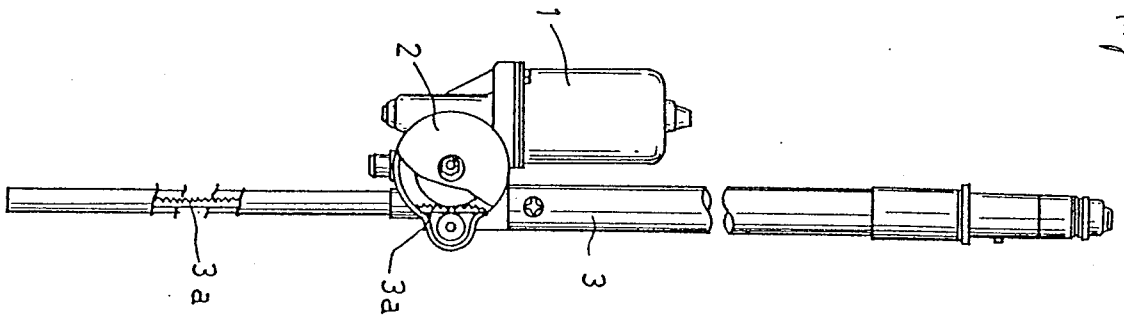
FIG. 5 is a schematic structural diagram of a motor driven telescopic antenna.

FIG. 1 and FIG. 2 show an embodiment of this invention. FIG. 1 is a sectional view, and FIG. 2 is an exploded perspective view. In these Figures, the portions which are the same as those in FIG. 5 are marked with the same reference numerals.

In FIG. 1 and FIG. 2, 11 denotes an antenna gear as a first rotor for operating (feeding in and out) a drive cord 3*a* of a telescopic antenna 3. This antenna gear 11 is inserted over a main shaft 12. The foregoing main shaft 12 is formed into a nearly elliptical section, and along the end portion of the shaft, a screw thread 12*a* is formed.

That represented by 13 is a roller disposed to face toward the antenna gear 11, to hold the drive cord 3*a* in between. That designated by 14 is a ring-form member that is inserted over the main shaft 12 by engaging with it and is provided on both its end surfaces in the shaft direction with uneven or protruding portions 14*a*.

That indicated by 15 is a motor gear as a second rotor that is concentric with the ring-form member 14 in a rotatable manner, and rotated by an electric motor 1. This motor gear 15 is made rotatable by means of a worm gear 16 that is fitted onto a shaft 1*a* of the electric motor 1. Those represented by 17 and 18 are first and second clutch discs inserted over the main shaft 12 in order to hold both end surfaces of the motor gear 15 in between. In these first and second clutch discs 17 and 18, uneven portions 17*a* and 18*a* corresponding to the uneven portions 14*a* of the ring-form member 14 are formed. Also, on the end surfaces of the foregoing first and second clutch discs 17 and 18, which do not come into contact with the motor gear 15, circular protrusions 17*b* and 18*b*, which prevent surface contact with the antenna gear 11 and a washer 19 that will be mentioned later, are formed.

The washer 19 is inserted over the main shaft 12, and disposed on the upper side of the second clutch disc 18. On the upper side of this washer 19, a clip spring 20 is disposed, and through this clip spring 20, a nut 21 is screwed onto the thread 12*a* of the main shaft 12. In this case, the washer 19, the clip spring 20 and the nut 21 compose a fixture, and this fixture press-holds the motor gear 15 by applying the pressurizing force to the first and second clutch discs 17 and 18.

Also, by the uneven portions 14*a* of the ring-form member 14 and the uneven portions 17*a* and 18*a* of the first and second clutch discs 17 and 18, the clutch pressure setting means is constructed.

For the antenna gear 11 and the motor gear 15, by taking the self-lubricating function and the wear resistance into consideration, it is preferable to use resin materials, such as Duracon. Also, for the first and second clutch discs 17 and 18, with the heat resistance taken into account, it is desirable to use resin materials, such as Duranex.

Hereunder, a description will be provided on the normal load state and the overload state with regard to the function of this embodiment constructed as mentioned above.

Normal Load State

By the driving motion of the electric motor 1, the worm gear 16 rotates, and the motor gear 15 rotates. In this case, the uneven portions 17*a* and 18*a* of the first and second clutch discs 17 and 18 are engaged with the uneven portions 14*a* of the ring-form member 14. Also, the first and second clutch discs 17 and 18 are press-holding both end surfaces of the motor gear 15, with the pressure of the fixture. Because the ring-form member 14 is engaged with the main shaft 12, with a specified clutch pressure that is preset, the power of the motor gear 15 is transmitted to the ring-form member 14 through the first and second clutch discs 17 and 18, thereby causing the antenna gear 11 to rotate. As a result, the drive cord 3*a* of the telescopic antenna 3 is fed in or out by the feeding out motion of the roller 13. In other words, normal power transmission is performed.

Overload State

The same as in the case mentioned above, by the driving motion of the electric motor 1, the worm gear rotates, and the motor gear 15 is rotated. However, in this case, it is assumed that the overload state is caused due to the adhesion of dirt, etc. to the clutch portion or clogging caused by mud in the antenna unit, or by some other reason. During normal load, the uneven portions 17*a* and 18*a* of the first and second clutch discs 17 and 18 are engaged with the uneven portions 14*a* of the ring-form member 14. However, in this case, because of the overload (the clutch pressure exceeds the preset pressure), the uneven portions 17*a* and 18*a* become misaligned or offset from the uneven portions 14*a*. In particular, the uneven portions 17*a* and 18*a* of the first and second clutch discs 17 and 18 slightly ride over the uneven portions 14*a* of the cam ring-form member. As a result, the first and second clutch discs 17 and 18, which press-hold both end surfaces of the motor gear 15 with pressure applied by the fixture during the normal load state, become dissociated slightly in the shaft direction, against the foregoing pressurizing force. Consequently, the first and second clutch discs 17 and 18 become detached slightly from both end surfaces of the motor gear 15 and the first and second clutch discs 17 and 18 slip relative to the motor gear 15. Thus, transmission of power becomes reduced.

As has been described above, according to this embodiment the following operational effects are obtained.

In the clutch system of this embodiment, although the transmission of the driving force from the electric motor side to the antenna side is effected depending on frictional transmission, a pressure setting means for detecting whether the clutch pressure is exceeding the preset pressure or not, by using the engagement and nonengagement (misalignment) between the uneven portions 14*a* of the ring-form member 14 and the uneven portions 17*a* and 18*a* of the first and second clutch discs 17 and 18 as the means for determination, is provided. Therefore, driving of the electric motor with a pressure over the preset clutch pressure is prevented, and damage to the electric motor due to burning, etc. is prevented.

Also, in this embodiment, the pressure setting means for determining whether the pressure is exceeding the preset clutch pressure or not is formed with the uneven portions 14*a* of the ring-form member 14 and the uneven portions 17*a* and 18*a* of the first and second clutch discs 17 and 18, and is provided close to the main shaft 12 where the intrusion of dirt, contaminants, etc. occurs relatively less frequently. Consequently, malfunctions, etc. in the clutch operation due to the intrusion of dirt, contaminants, etc. can be minimized.

Furthermore, since the pressurizing force of the first and second clutch discs 17 and 18 applied to the motor gear 15 can be controlled by tightening or loosening the nut 21, even when the contact surface of the first clutch disc 17, the second clutch disc 18 or the motor gear 15 becomes worn, the above mentioned pressurizing force can be adjusted to be a specified value.

Figure 3:
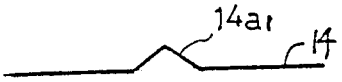
FIGS. 3(*a*), 3(*b*) and FIG. 4 are diagrams showing the other embodiments of this invention.
Figure 3:
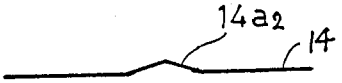

The embodiment of this invention may be modified as described below:

1. As shown in FIGS. 3(*a*) and 3(*b*), by making the uneven portion of the ring-form member 14 into that of 14*a*1 having a greater tilt angle or into that of 14*a*2 having a lesser tilt angle, optional pressure may be set for the clutch pressure.

Figure 4:
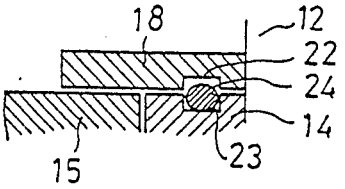

2. The clutch pressure setting means formed by the uneven portions of the ring-form member 14 and the uneven portions of the first and second clutch discs 17 and 18, may be constructed as shown in FIG. 4. That is, a recessed portion 23 is formed in the ring-form member 14, and corresponding to this recessed portion 23, a recessed portion 22 is formed in each of the first and second clutch discs 17 and 18 (only the disc 18 is shown in FIG. 4). Then, as a member for forming the tilt as a protrusion in both these recessed portions 22 and 23, for example, a spherical body 24 is provided. The pressure setting means is also not limited to those described in the above mentioned embodiments, but various types of modifications may be used so long as it is designed to cause the first and second clutch discs 17 and 18 to be dissociated from the motor gear 15 (regardless of the extent of the dissociation), when a force exceeding the preset clutch pressure is applied to the surfaces between the motor gear 15 and the first and second clutch discs 17 and 18.

As should be apparent from the detailed description given above, in this invention, on the main shaft over which the first rotor for operating the drive cord of the telescopic antenna is inserted, the second rotor that is rotated by the electric motor is provided in a manner rotatable against this main shaft. Also, in order to hold both end surfaces of the foregoing second rotor in between, the first and second clutch discs are inserted over the main shaft; then, first and second clutch discs are clamped in the shaft direction by the clamp, so that the first and second clutch discs press hold the second rotor by pressurizing it. Furthermore, the clutch pressure setting means, which dissociates the first and second clutch discs from the second rotor when a force exceeding the preset clutch pressure is applied to the surfaces held between the second rotor and the first and second clutch discs is provided.

In the structure as mentioned above, under normal load, power is transmitted by the frictional transmission depending on the normal friction between the second rotor and the first and second clutch discs. At the time of overload, because the clutch pressure is above the preset clutch pressure, the first and second clutch discs becomes dissociated from the second rotor, by the clutch pressure setting means and slip. Therefore, the transmission of the power is reduced, and the second rotor can rotate under a light load nearly equal to the preset clutch pressure. In this manner, a clutch system for the motor driven telescopic antenna that is capable of performing the clutching operation with a preset clutch pressure even when the overloaded state is brought about can be provided.

I claim:

1. A frictional disc-type clutch system for a motor driven telescopic antenna, that comprises:

a main shaft with a first rotor fitted thereon, said first rotor operating an antenna drive cord of a telescopically adjustable antenna;

a second rotor which is inserted rotatably over said main shaft and is rotated by an electric motor;

first and second clutch discs which are inserted over said main shaft in order to hold both end surfaces of said second rotor in between;

a clamp for clamping said first and second clutch discs in the shaft direction so that said first and second clutch discs hold said second rotor in between with a pressurizing force applied to said second rotor; and a clutch pressure setting means for setting a specified pressure for said first and second clutch discs to separate from and slip relative to said second rotor when a force exceeding said specified pressure is applied between said second rotor and said first and second clutch discs, said clutch pressure setting means comprising a ring-form member that is engaged with and inserted over said main shaft coaxially and on a center side of the said second rotor and means provided on said ring-form member for causing said first and second clutch discs to separate from said second rotor when said specified pressure is exceeded.

2. A clutch system for a motor driven telescopic antenna, that comprises:

a main shaft with a first rotor fitted thereon, said first rotor operating an antenna drive cord of a telescopically adjustable antenna;

a second rotor which is inserted rotatably over said main shaft and is rotated by an electric motor;

first and second clutch discs which are inserted over said main shaft in order to hold both end surfaces of said second rotor in between;

a clamp for clamping said first and second clutch discs in the shaft direction so that said first and second clutch discs hold said second rotor in between with a pressurizing force applied to said second rotor; and a clutch pressure setting means for dissociating said first and second clutch discs from said second rotor when a force exceeding a specified clutch pressure that is set in relation to the engagement with said main shaft is applied to the surfaces held between said second rotor and said first and second clutch discs, the clutch pressure setting means being comprised of first uneven portions formed on both end surfaces, in the shaft direction, of a ring-form member that is engaged with and inserted over said main shaft coaxially and on the center side of said second rotor; and second uneven portions provided in said first and second clutch discs corresponding to said uneven portions of the ring-form member.

* * * * *